US005586716A

United States Patent [19]

Correll

[11] Patent Number: 5,586,716

[45] Date of Patent: Dec. 24, 1996

[54] DESIGNER-COVER BOX

[76] Inventor: John D. Correll, 8459 Holly Dr., Canton, Mich. 48187

[21] Appl. No.: 278,258

[22] Filed: Jul. 21, 1994

Related U.S. Application Data

[63] Continuation-in-part of Ser. No. 11,739, Aug. 13, 1993, Pat. No. Des. 356,254, Ser. No. 272,677, Jul. 8, 1994, and Ser. No. 86,318, Jul. 6, 1993.

[51] Int. Cl.[6] ..... B65D 5/42; B65D 5/56

[52] U.S. Cl. ..... 229/110; 229/126; 229/178; 229/906

[58] Field of Search ..... 229/109, 110, 229/126, 152, 154, 178, 906

[56] References Cited

U.S. PATENT DOCUMENTS

| | | | |
|---|---|---|---|
| D. 329,806 | 9/1992 | Kindt | D9/430 |
| D. 356,254 | 3/1995 | Correll | D9/423 |
| 1,641,012 | 8/1927 | Schleicher . | |
| 2,330,031 | 9/1943 | Cranshaw | 229/126 |
| 2,819,833 | 1/1958 | Sauer | 229/109 |
| 2,839,236 | 6/1958 | Dunning | 229/145 |
| 2,925,213 | 2/1960 | Zukoski | 229/109 |
| 4,201,331 | 5/1980 | Austin . | |
| 4,360,118 | 11/1982 | Stern | 220/4.24 |
| 4,362,266 | 12/1982 | Webinger | 229/110 |
| 4,620,666 | 11/1986 | Lacasa et al. | 229/110 |
| 4,765,534 | 8/1988 | Zion et al. | 229/109 |
| 4,848,543 | 7/1989 | Doboze | 206/45.32 |
| 4,877,609 | 10/1989 | Beck et al. | 206/551 |
| 4,886,179 | 12/1989 | Volk | 220/23.4 |
| 5,000,374 | 3/1991 | Deiger | 229/109 |
| 5,060,851 | 10/1991 | Lorenz | 220/4.24 |
| 5,110,039 | 5/1992 | Philips | 229/110 |
| 5,118,032 | 6/1992 | Geho | 229/110 |
| 5,209,392 | 5/1993 | Anatro | 229/906 |
| 5,211,329 | 5/1993 | Patton | 229/906 |
| 5,263,634 | 11/1993 | Korine | 229/109 |
| 5,273,174 | 12/1993 | Fisher | 220/4.21 |

FOREIGN PATENT DOCUMENTS

| | | | |
|---|---|---|---|
| 2476602 | 8/1981 | France | 229/110 |

*Primary Examiner*—Gary E. Elkins

[57] ABSTRACT

A type of container allowing use of one or more sections of recessed cover edge that can be used for creating a uniquely shaped cover, thereby (a) providing a cover that can be shaped into the contour of a company logo or other unique graphic element and (b) providing a container that can be differentiated from competitors' containers and can be designed for extra strong memorability. The box is typically used for packaging relatively flat food products such as pizza and the like; however, it can serve other purposes, as well.

8 Claims, 3 Drawing Sheets

FIG-5
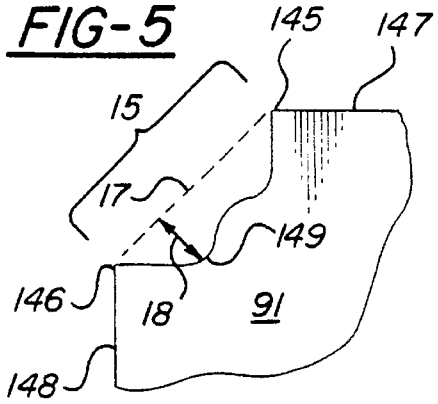
FIG-6
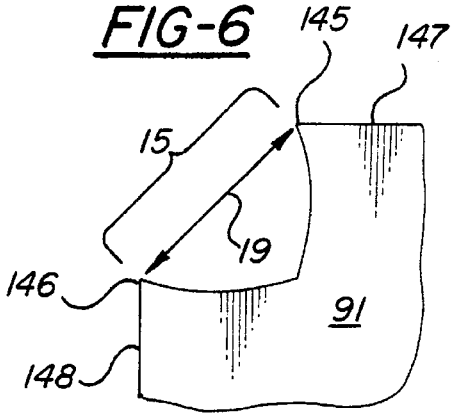
FIG-7
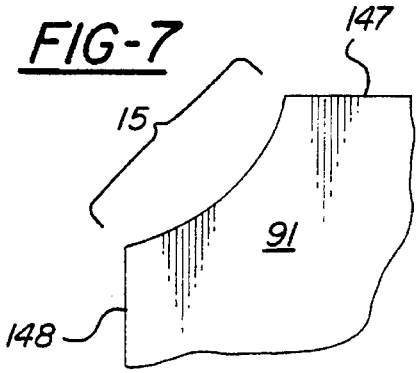
FIG-8
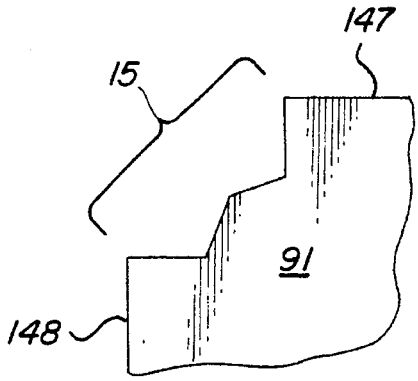
FIG-9
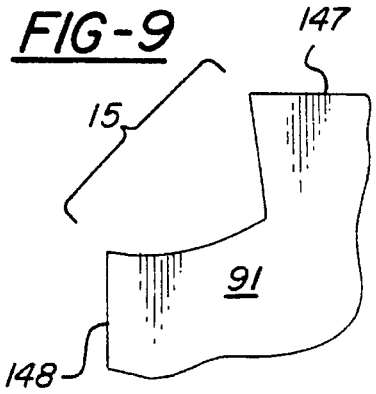
FIG-10
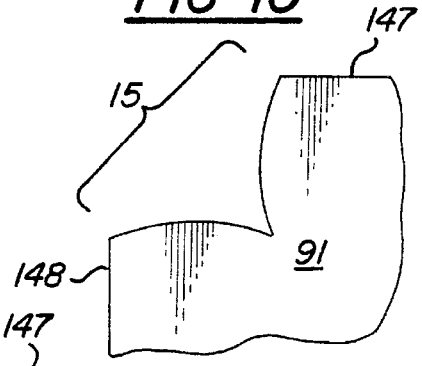
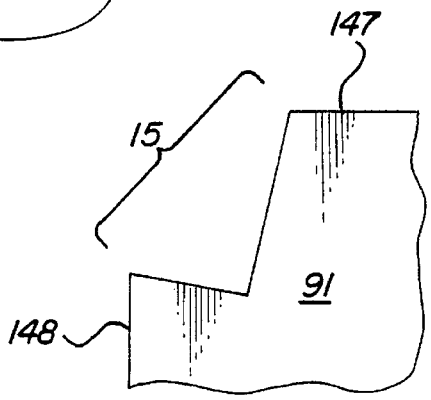
FIG-11

DESIGNER-COVER BOX

CROSS REFERENCES TO RELATED APPLICATIONS

This is a continuation-in-part application of my application Ser. No. 29/011,739, entitled "Pizza Box," filed on Aug. 13, 1993 now U.S. Pat. No. D356,254, my application Ser. No. 08/086,318, entitled "Box with Convertible Corner," filed on Jul. 6, 1993, and my application Ser. No. 08/272,677 entitled "Mating Box Blanks" filed on Jul. 8, 1994 pending.

FIELD OF THE INVENTION

This invention relates to containers for food products and, in particular, to food-carrying boxes made of foldable material.

DESCRIPTION OF THE PRIOR ART

In the pizzeria industry, there is great similarity in appearance between pizza boxes of competing pizza companies. Specifically, a majority of the companies, including Pizza Hut, Little Caesars, and thousands of others, use the same shape of box—namely, a square box. As a result, one pizza company's box looks fundamentally the same as other companys' boxes, the only variation being a cosmetic difference produced by cover printing.

Several years ago Domino's Pizza switched from a square box to an octagon box. This box is described in Zion et al. U.S. Pat. No. 4,765,534 granted on Aug. 23, 1988. Since then there have been several variations in pizza box shape. One variation involves changing two of the corners on a square box to diagonal walls, thereby creating a D-shape box. One such example is described in Philips U.S. Pat. No. 5,110,039 granted on May 5, 1992. Another variation of pizza box shape involves rounding out the diagonal edges of the cover and bottom panel, for purported safety benefits, thereby creating an octagon box with a cover and bottom panel having four straight side edges and four rounded corners. This variation is found in Korine U.S. Pat. No. 5,263,634 granted on Nov. 23, 1993.

Over the years, other types of irregular-shaped boxes have been designed. One such box, a seven-sided two-piece box with a heart-shaped cover, is described in Schleicher U.S. Pat. No. 1,641,012 granted on Aug. 30, 1927. While achieving an unusual appearance, such boxes have been of a shape that is unsuitable for packaging pizza and, further, have been of a design that fails to meet the packaging performance, efficiency, and cost requirements of a pizza company.

However, regardless of the several above-described developments in box shape and design, the opportunity for a pizza company to differentiate its box from competitors' boxes has been very small. So, there has remained a problem for pizza companies and box manufacturers of how to create a box that has a unique shape and, therefore, a distinctive appearance. This problem has not been solved by the prior art but is solved by this invention. By solving this problem, a pizza company can have a uniquely shaped box that is fundamentally different from its competitors' boxes.

In addition, whenever a pizza company prints its logo on a box or carton, it is desirable to present the logo in a strong, memorable format. As a result, many pizza companies would benefit by having a box cover that conforms in shape with at least a portion of its company logo. This would enable them to print a large logo on the special logo-shaped box cover which, in turn, would virtually make the box into a three-dimensional embodiment of the company logo, thereby making for a very strong presentation of the logo and, concurrently, creating a very memorable box or pizza carton. However, up to now, no pizza carton has been of a design that lends itself to modification for conforming to the shape of a company logo or other graphic element. So, there has remained a problem for pizza companies of how to package their product for optimum presentation of the company logo and for maximum memorability of the package. This problem has not been solved by the prior art but is solved by this invention. By solving this problem, a pizza company can incorporate its logo or other graphic element into the contour of its box cover and, thereby, enhance the presentation of its logo and memorability of its package.

In conclusion, it would be highly desirable to provide a designer-cover pizza box that overcomes the above-described problems and disadvantages.

OBJECT AND ADVANTAGES

Accordingly, the object of my invention is a food-carrying container of unique geometric shape that performs within a pizza company's requirements of functionality and cost containment for pizza packaging.

The advantages of my invention are as follows:

1. The invention allows a pizza company to deliver their product in a container of fundamentally different appearance than other companys' containers and, thereby, have a totally unique, distinctive-looking package.

2. The invention allows a pizza company to create a box cover contour that conforms to the contour of its logo or other graphic element, thereby making the box into a three-dimensional embodiment of the logo and also making the box into a strong, memorable package.

Further objects and advantages of the invention will become apparent from consideration of the following detailed description, related drawings, and appended claims, all of which form a part of this specification.

SUMMARY OF THE INVENTION

In accordance with the invention, a container is provided that allows a special cover shape derived from one or more sections of recessed cover edge.

Further, a container is provided having a certain cover shape derived from sections of recessed cover edge, thereby providing a container that certain pizza companies can use for differentiating from competitors' containers.

A complete understanding of the invention can be obtained from the detailed description that follows.

BRIEF DESCRIPTION OF THE DRAWINGS

FIG. 5 is a plan view of a section of recessed cover edge having a type of curvilinear shape.

FIG. 6 is a plan view of a section of recessed cover edge having a type of arch-like shape.

FIG. 7 is a plan view of a section of recessed cover edge having a type of arcuate shape.

FIG. 8 is a plan view of a section of recessed cover edge having a type of jagged shape.

FIG. 9 is a plan view of a section of recessed cover edge having one straight edge adjoining one curved edge.

FIG. 10 is a plan view of a section of recessed cover edge having a first curved edge adjoining a second curved edge.

FIG. 11 is a plan view of a section of recessed cover edge having a first straight edge adjoining a second straight edge.

LIST OF REFERENCE NUMERALS

Figure 1:
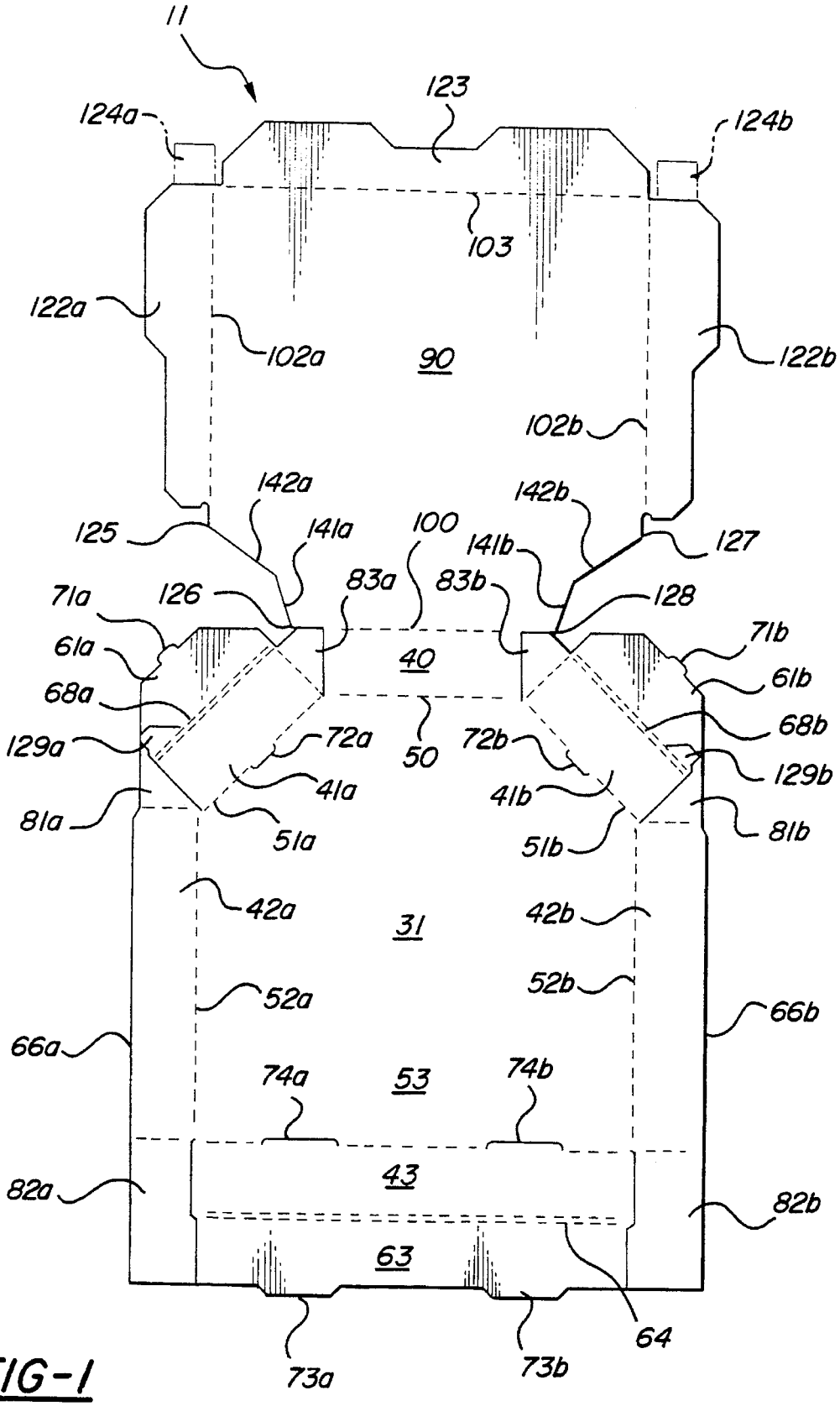
FIG. 1 is a plan view of a blank for making the box of the preferred embodiment.

Within a drawing, closely related figures have the same number but different alphabetic suffixes. Between drawings, like reference numerals designate corresponding parts.

| | |
|---|---|
| 11 | blank of preferred embodiment |
| 12 | box of preferred embodiment |
| 13 | first section of recessed cover edge |
| 15 | section of recessed cover edge |
| 17 | imaginary line between edge points |
| 18 | dimension line indicating predetermined maximum depth |
| 19 | dimension line indicating predetermined distance |
| 31 | bottom panel |
| 40 | rear wall |
| 41a | first side wall |
| 41b | second side wall |
| 42a | third side wall |
| 42b | fourth side wall |
| 43 | front wall |
| 50 | rear wall fold line |
| 51a | first side wall fold line |
| 51b | second side wall fold line |
| 52a | third side wall fold line |
| 52b | fourth side wall fold line |
| 53 | front wall fold line |
| 61a | first ancillary wall panel |
| 61b | second ancillary wall panel |
| 63 | third ancillary wall panel |
| 64 | top edge of wall |
| 66a | top edge of wall |
| 66b | top edge of wall |
| 68a | top edge of wall |
| 68b | top edge of wall |
| 71a | first ancillary wall panel locking tab |
| 71b | second ancillary wall panel locking tab |
| 72a | first slot-forming slit |
| 72b | second slot-forming slit |
| 73a | ancillary wall locking tab |
| 73b | ancillary wall locking tab |
| 74a | slot-forming slit |
| 74b | slot-forming slit |
| 81a | first side corner flap |
| 81b | second side corner flap |
| 82a | first front corner flap |
| 82b | second front corner flap |
| 83a | first rear corner flap |
| 83b | second rear corner flap |
| 90 | cover panel |
| 91 | cover panel |
| 100 | rear cover edge and cover fold line |
| 102a | first side cover edge |
| 102b | second side cover edge |
| 103 | front cover edge and cover front flap fold line |
| 122a | first cover side flap |
| 122b | second cover side flap |
| 123 | cover front flap |
| 124a | optional cover locking flap |
| 124b | optional cover locking flap |
| 125 | first edge point |

-continued

| | |
|---|---|
| 126 | second edge point |
| 127 | third edge point |
| 128 | fourth edge point |
| 129a | cover flap engagement tab |
| 129b | cover flap engagement tab |
| 141a | first straight edge |
| 141b | first straight edge |
| 142a | second straight edge |
| 142b | second straight edge |
| 145 | edge point |
| 146 | edge point |
| 147 | cover edge |
| 148 | cover edge |
| 149 | furthermost point |
| 150a | first side wall plane |
| 150b | second side wall plane |
| X | outside angle |
| Y | outside angle |
| Z | outside angle |
| X' | outside angle |
| Y' | outside angle |
| Z' | outside angle |

DESCRIPTION OF THE PREFERRED EMBODIMENT

Referring now to the drawings, there is shown an illustrative embodiment of the invention in a one-piece blank and, correspondingly, a box created from the blank. The following discussion describes a blank 11 shown in FIG. 1. However, when blank 11 is set up into a box, it becomes box 12 shown in FIGS. 2, 3, and 4. Therefore, by extrapolation, the following discussion also applies to box 12 of FIGS. 2, 3, and 4. It will be appreciated, as the description proceeds, that my invention may be realized in different embodiments and may be used in other applications.

In FIG. 1 there is shown a blank 11 of the preferred embodiment of the invention. Blank 11 has a bottom panel 31. A rear wall 40 is hingedly attached to bottom panel 31 at a rear wall fold line 50. First, second, third, and fourth side walls 41*a*, 41*b*, 42*a*, and 42*b*, respectively, are hingedly attached to bottom panel 31 at first, second, third, and fourth side wall fold lines 51*a*, 51*b*, 52*a*, and 52*b*, respectively. Side walls 42*a* and 42*b* have top edges 66*a* and 66*b*, respectively. A front wall 43 opposing rear wall 40 is hingedly attached to bottom panel 31 at front wall fold line 53. Side walls 41*a* and 41*b* are disposed at an oblique angle to rear wall 40 and, as such, they function as rear diagonal walls in the embodiment. Side walls 42*a* and 42*b* are disposed perpendicularly to front wall 43.

First and second ancillary wall panels 61*a* and 61*b*, respectively, are hingedly attached to top edges 68*a* and 68*b*, respectively, of first and second side walls 41*a* and 41*b*, respectively. When the blank is set up into a box, ancillary wall panels 61*a* and 61*b* function as inner wall panels for side walls 41*a* and 41*b*. Projecting from a bottom edge of ancillary wall panels 61*a* and 61*b* are first and second ancillary wall panel locking tabs 71*a* and 71*b*, respectively, which engage in slots created from slot-forming slits 72*a* and 72*b*, respectively, when the blank is set up into a box. A third ancillary wall panel 63 is hingedly attached to a top edge 64 of front wall 43. Front wall 43 has two ancillary wall panel locking tabs, 73*a* and 73*b*, which engage in two slots created from two slot-forming slits, 74*a* and 74*b*, when the blank is set up into a box.

First and second side corner flaps 81*a* and 81*b*, respectively, are hingedly attached to rear ends of side walls 42*a* and 42*b*, respectively. When the blank is set up into a box, corner flap 81*a* is enclosed between side wall 41*a* and ancillary wall panel 61*a*, and corner flap 81*b* is enclosed between side wall 41*b* and ancillary wall panel 61*b*. Additionally, first and second front corner flaps 82*a* and 82*b*, respectively, are hingedly attached to front ends of side walls 42*a* and 42*b*, respectively. When the blank is set up into a box, corner flaps 82*a* and 82*b* are enclosed between front wall 43 and ancillary wall panel 63. Further, first and second rear corner flaps 83*a* and 83*b*, respectively, are hingedly attached to rear ends of side walls 41*a* and 41*b*, respectively. When the blank is set up into a box, corner flaps 83*a* and 83*b* are disposed interior to rear wall 40.

Figure 2:
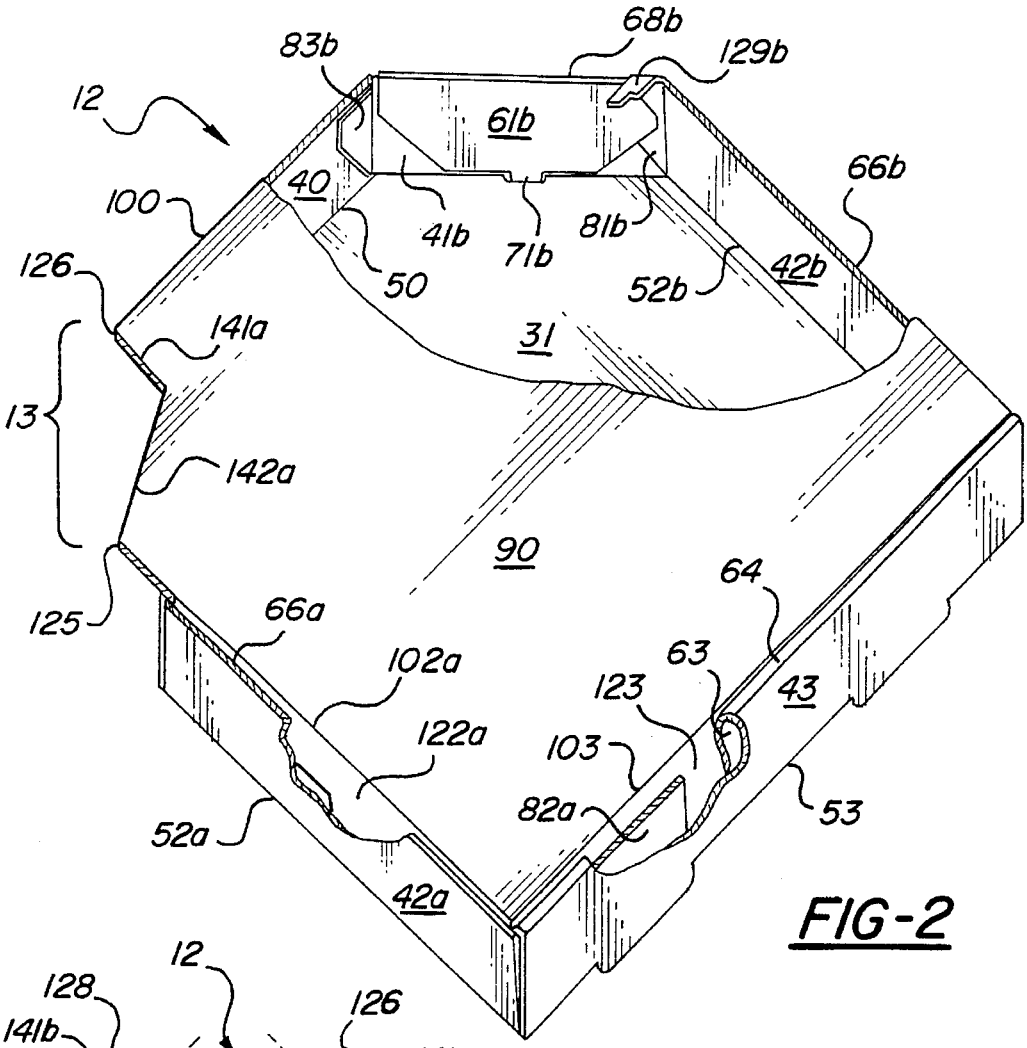
FIG. 2 is a perspective view of the box formed from the blank of FIG. 1.

A cover panel 90 is hingedly attached to a top edge of rear wall 40. Cover panel 90 has a rear cover edge 100, a first pair of adjoining first and second straight edges 141*a* and 142*a*, respectively, a second pair of adjoining first and second straight edges 141*b* and 142*b*, respectively, opposing first and second side cover edges 102*a* and 102*b*, respectively, and a front cover edge 103 opposing rear cover edge 100. The first pair of straight edges 141*a* and 142*a* constitute a first section of recessed cover edge. The outer limits or boundary points of the first section of recessed cover edge are first and second edge points 125 and 126, respectively. The second pair of straight edges 141*b* and 142*b* constitute a second section of recessed cover edge. The outer limits or boundary points of the second section of recessed cover edge are third and fourth edge points 127 and 128, respectively. In FIG. 2 the first section of recessed cover edge is indicated by numeral 13.

Figure 3:
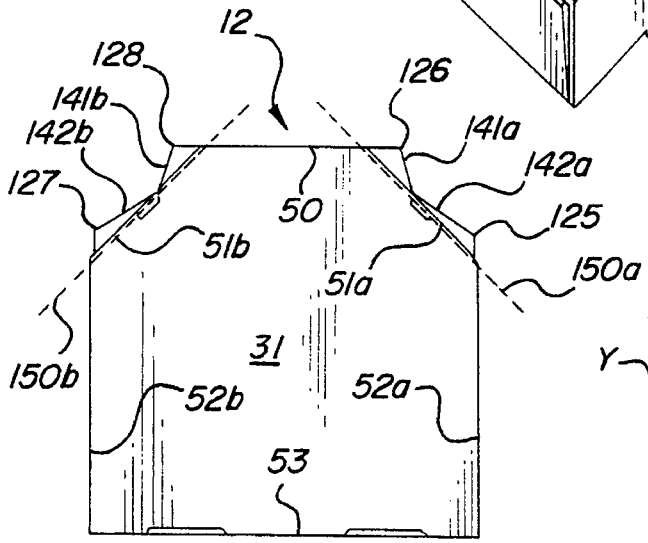
FIG. 3 is a bottom view of the box formed from the blank of FIG. 1 showing first and second sections of recessed cover edge disposed exterior to the planes of first and second side walls, respectively.

When blank 11 is set up into box 12, the first and second sections of recessed cover edge are disposed exterior to or outside of the planes of side walls 41*a* and 41*b*, respectively. FIG. 3 shows a bottom view of box 12 with first and second straight edges 141*a* and 142*a* disposed exterior to plane 150*a* of side wall 41*a*. It also shows straight edges 141*b* and 142*b* disposed exterior to plane 150*b* of side wall 41*b*. Although walls 41*a* and 41*b* are not indicated in the drawing because they are concealed by bottom panel 31, it is understood that they have the location of edges 51*a* and 51*b*, respectively, which are indicated in the drawing. (Sections of recessed cover edges are discussed in more detail in a succeeding paragraphs.)

Cover panel 90 is hingedly attached to a top edge of rear wall 40 at a cover fold line. In this embodiment, the cover fold line is in the same location as rear cover edge 100, therefore, to avoid confusion, only rear cover edge 100 is indicated in the drawing and it is understood that the cover fold line is where rear cover edge 100 is indicated. First and second cover side flaps 122*a* and 122*b*, respectively, are hingedly attached to side cover edges 102*a* and 102*b*, respectively, at first and second cover side flap fold lines. In this embodiment, the first and second cover side flap fold lines are in the same location as first and second side cover edges 102*a* and 102*b*, respectively, therefore, to avoid confusion, only first and second side cover edges 102*a* and 102*b* are indicated in the drawing and it is understood that the first and second cover side flap fold lines are where first and second side cover edges 102*a* and 102*b* are indicated. A cover front flap 123 is hingedly attached to front cover edge 103 at a cover front flap fold line. In this embodiment, the cover front flap fold line is in the same location as front cover edge 103, therefore, to avoid confusion, only front cover edge 103 is indicated in the drawing and it is understood that the cover front flap fold line is where front cover edge 103 is indicated.

When the blank is set up into a box, flaps 122*a*, 122*b*, and 123 are disposed inside of the box, or interior to walls 42*a*, 42*b*, and 43, respectively. However, as an alternate configuration, flaps 122*a* and 122*b* may be disposed outside of the box. In this case, optional cover locking flaps 124*a* and 124*b* (shown with dashed lines in the drawing) are hingedly attached to the front ends of flaps 122*a* and 122*b*, respectively. With this configuration, when the blank is set up into a box, optional locking flaps 124*a* and 124*b* are enclosed between front wall 43 and ancillary wall panel 63, thereby locking cover 90 into a securely closed position.

Hingedly attached to the top edges 68*a* and 68*b* of side walls 41*a* and 41*b* are cover flap engagement tabs 129*a* and 129*b*, respectively. When the blank is set up into a box, as shown in FIG. 2, engagement tabs 129*a* and 129*b* extend perpendicularly from the top edges 68*a* and 68*b* toward the interior of the box. (Engagement tab 129*b* is shown in the drawing, tab 129*a* is hidden by cover 90.) When cover 90 is closed on the box and cover side flaps 122*a* and 122*b* are disposed inside of the box, engagement tabs 129*a* and 129*b* frictionally engage the rear ends of side flaps 122*a* and 122*b*, thereby helping to hold cover 90 in a closed position.

Returning now to the first and second sections of recessed cover edge. The first section of recessed cover edge is constituted by the first pair of adjoining first and second straight edges 141*a* and 142*a*, respectively, and is bounded by first and second edge points 125 and 126, respectively. The second section of recessed cover edge is constituted by the second pair of adjoining first and second straight edges 141*b* and 142*b*, respectively, and is bounded by third and fourth edge points 127 and 128, respectively. In the embodiment, the first and second sections of recessed cover edge are of similar shape.

As used herein, the term "recessed cover edge" refers to a portion of the perimeter edge of a cover that recedes or projects inward from an imaginary straight line between two edge points. The term "edge point" refers to a point on a convex curved portion of the edge of the cover and also to a point at the end of any curved portion of the edge of the cover and to a point at the end of any straight portion of the edge of the cover. To determine if a portion of perimeter cover edge constitutes a section of recessed cover edge, establish an imaginary straight line between two edge points and if the portion of cover edge between the points lies inside of or interior to the imaginary line, then that portion of perimeter edge would constitute a section of recessed cover edge. Referring to FIG. 5 as an example, on a portion of a cover 91 with side edges 147 and 148, an imaginary straight line 17 (shown in dashes) extends between edge points 145 and 146 and a portion of cover edge 15 (indicated by a bracket designated with numeral 15) lies interior to line 17, so that portion of interior-lying cover edge constitutes a "section of recessed cover edge."

There is a predetermined maximum depth to a section of recessed cover edge. That depth extends from imaginary line 17 to a furthermost point on the section of recessed cover edge. Referring to FIG. 5 for illustration, a dimension line 18 that extends perpendicularly from line 17 to a furthermost point 149 indicates the predetermined maximum depth of the section of recessed cover edge (indicated by a bracket designated with numeral 15).

There is also a predetermined distance between edge points. Referring to FIG. 6 for illustration, a dimension line 19 indicates the predetermined distance between edge points 145 and 146.

In the embodiment of blank 11 and box 12, the cover is of such size that it overlaps at least a portion of top edges 68*a* and 68*b* when the cover is closed on the box. Because of the sections of recessed cover edge, the contour of cover panel 90 is different from the contour of bottom panel 31. In the embodiment, the first and second sections of recessed cover edge consist of free edge (i.e., no flaps or panels hingedly attached thereto).

There are hundreds of configurations that a section of recessed cover edge may assume, however, when categorized, many of the configurations consist of either a single curvilinear edge, a single arcuate edge, two adjoining curved edges, a straight edge adjoining a curved edge, or two adjoining straight edges.

Figure 4:
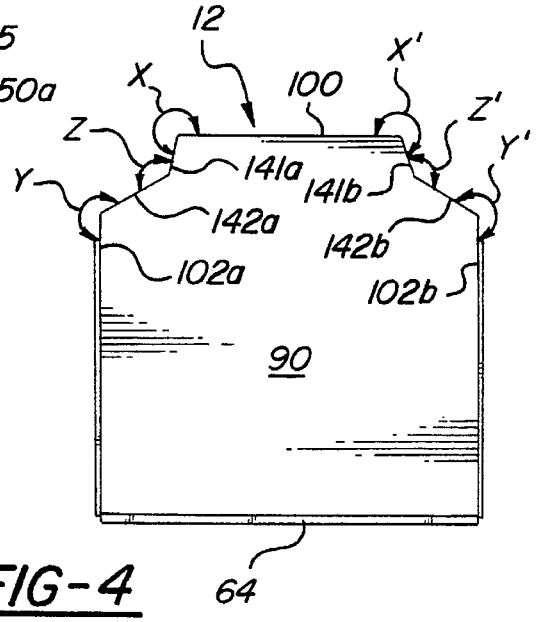
FIG. 4 is a top view of the box formed from the blank of FIG. 1 showing outside angles.

In FIG. 2 the first section of recessed cover edge is indicated by a bracket designated with numeral 13. FIG. 4 shows a top view of box 12 with the outside angles of the first and second sections of recessed cover edge indicated. Referring to FIG. 4, an outside angle X is formed from the intersection of edge 141*a* with edge 100. In the embodiment, angle X is approximately 249 degrees, however, other angular degrees are possible. An outside angle Y is formed from the intersection of edge 142*a* with 102*a* and is approximately 237 degrees, however, other angular degrees are possible. An outside angle Z is formed from the intersection of edges 141*a* and 142*a* and is approximately 145 degrees, however, other angular degrees are possible. In the second section of recessed cover edge a similar relationship exists between edges 141*b*, 142*b*, 102*b*, and 100 and the corresponding angles are indicated by X', Y', and Z'.

FIGS. 5–11 give examples of various types of recessed cover edge sections. Each of FIGS. 5–11 show a portion of a cover 91 with side edges 147 and 148 and a section of recessed cover edge that is indicated by a bracket designated with numeral 15. Specifically, FIGS. 5, 6, 7, and 8 show examples of a recessed cover edge in curvilinear, arch-like, arcuate, and jagged shapes, respectively. FIG. 9 shows an example of a recessed cover edge having one straight edge adjoining one curved edge. FIG. 10 shows an example of a recessed cover edge having two adjoining curved edges. FIG. 11 shows an example of a recessed cover edge having two adjoining straight edges.

FIG. 2 shows a perspective view of box 12 formed from blank 11 of FIG. 1. To fold blank 11 into box 12, the following procedure may be utilized. Fold front corner flaps 82*a* and 82*b* upright. Fold side walls 42*a* and 42*b* upright. Fold front wall 43 upright and then fold ancillary wall panel 63 downward until the ancillary wall panel locking tabs 73*a* and 73*b* slide into the slots 74*a* and 74*b*, respectively. Fold side wall 41*a* upright and then fold ancillary wall panel 61*a* downward until the ancillary wall panel locking tab 71*a* slides into slot 72*a*. Repeat this procedure to erect side wall 41*b*. Fold rear wall 40 and cover 90 upright. Fold cover side flaps 122*a* and 122*b* inward and, while holding the side flaps in, fold cover 90 downward until the cover is half closed. Then fold cover front flap 123 downward and, while holding the front flap in, finish closing the cover.

Lastly, within the context of this invention, a fold line can be created by a number of means such as, for example, by a crease or score in the board, by a series of aligned spaced short slits in the board, and by a combination of aligned spaced short and long slits. In some cases, when a long slit is bounded on the ends by a series of short slits or a score, the long slit may be slightly offset in alignment from the short slits or score for the purpose of creating a slot along the fold line when the blank is set up into a box. Nonetheless, the entire combination of long and short slits is considered to constitute a single fold line unless otherwise indicated. In addition, to create a fold line where one panel is folded 180° to lay parallel on another panel, the fold line may constitute two narrowly spaced parallel scores or series of aligned slits. In this case, the two narrowly spaced parallel scores or series of aligned slits constitute a single fold line unless otherwise indicated. In conclusion, as referred to herein, a fold line is any line between two points on the blank or box along which the board is intended to be folded when the blank is being erected into a box. The type of fold lines shown in the drawings are presently preferred but it will be appreciated that other methods known to those skilled in the art may be used.

CONCLUSION, RAMIFICATIONS, AND SCOPE

I have disclosed a type of box that can comprise one or more sections of recessed cover edge that can be used for creating a uniquely shaped box cover, thereby (a) providing a box cover that can be shaped into the contour of a company logo or other unique graphic element and (b) providing a box that can be differentiated from competitors' boxes and can be designed for extra strong memorability. The box is typically used for packaging relatively flat food products such as pizza and the like; however, it can serve other purposes, as well.

The illustrated number, size, shape, type, and placement of components represent the preferred embodiment; however, many other combinations and configurations are possible within the scope of the invention.

For example, as shown in FIG. 2, cover side flaps 122*a* and 122*b* are located inside the box; however, as previously discussed, they may be positioned outside the box, as well.

In conclusion, it is understood that my invention is not to be limited to the disclosed embodiment but, on the contrary, is intended to cover various modifications and equivalent arrangements included within the spirit and scope of the appended claims.

I claim:

1. A one-piece blank of foldable material cut and scored to define:

a bottom panel, a rear wall hingedly attached to said bottom panel at a rear wall fold line, a front wall opposing said rear wall and hingedly attached to said bottom panel at a front wall fold line, first and second diagonal walls hingedly attached to said bottom panel at first and second diagonal wall fold lines, respectively, said first and second diagonal wall fold lines each being disposed adjacent to and at an oblique angle to said rear wall fold line, first and second side walls hingedly attached to said bottom panel at first and second side wall fold lines, respectively, said first and second side wall fold lines each being disposed perpendicularly to said front wall fold line and extending to said first and second diagonal wall fold lines, respectively, first and second ancillary wall panels hingedly attached to a top edge of said first and second diagonal walls, respectively, first and second corner flaps hingedly attached to a first end of said first and second side walls, respectively, a cover hingedly attached to a top edge of said rear wall, said cover comprising a cover panel and first and second cover side flaps, said cover panel having a rear cover edge, a front cover edge opposing said rear cover edge, and first and second side cover edges, said first and second cover side flaps being hingedly attached to said first and second side cover edges, respectively, said cover panel having a first section of recessed cover edge disposed between first and second edge points and a second section of recessed cover edge disposed between third and fourth edge points.

2. A box of foldable material, said box comprising:

a bottom panel, a rear wall, a front wall opposing said rear wall, first and second diagonal walls each disposed adjacent to and at an oblique angle to said rear wall, said first and second diagonal walls each having a plane, first and second side walls disposed approximately perpendicular to said front wall and extending to said first and second diagonal walls, respectively, first and second ancillary wall panels hingedly attached to a top edge of said first and second diagonal walls, respectively, first and second corner flaps hingedly attached to a first end of said first and second side walls, respectively, said first corner flap being enclosed between said first diagonal wall and said first ancillary wall panel and said second corner flap being enclosed between said second diagonal wall and said second ancillary wall panel, a cover hingedly attached to a top edge of one of the walls of said box, said cover comprising a cover panel and first and second cover side flaps, said cover panel having a rear cover edge, a front cover edge opposing said rear cover edge, and first and second side cover edges, said first and second cover side flaps being hingedly attached to said first and second side cover edges, respectively, said cover panel having a first section of recessed cover edge disposed between first and second edge points on said cover panel and a second section of recessed cover edge disposed between third and fourth edge points on said cover panel, at least a portion of said first and second sections of recessed cover edge being disposed exterior to the plane of said first and second diagonal walls, respectively.

3. A one-piece blank of foldable material cut and scored to define:

a bottom panel, a rear wall hingedly attached to said bottom panel at a rear wall fold line, a front wall hingedly attached to said bottom panel at a front wall fold line, said front wall fold line being disposed approximately parallel to said rear wall fold line, a first diagonal wall hingedly attached to said bottom panel at a first diagonal wall fold line, said first diagonal wall fold line being disposed adjacent to and at an oblique angle to said rear wall fold line, a first side wall hingedly attached to said bottom panel at a first side wall fold line, said first side wall fold line being disposed adjacent to and at an oblique angle to said first diagonal wall fold line and perpendicular to said front wall fold line, a cover hingedly attached to a top edge of said rear wall.

4. The blank defined in claim 3:

wherein said foldable material is corrugated paperboard;

said blank further comprising:

a second diagonal wall hingedly attached to said bottom panel at a second diagonal wall fold line opposing said first diagonal wall fold line, said second diagonal wall fold line being disposed adjacent to and at an oblique angle to said rear wall fold line, a second side wall hingedly attached to said bottom panel at a second side wall fold line opposing said first side wall fold line, said second side wall fold line being disposed adjacent to and at an oblique angle to said second diagonal wall fold line and perpendicular to said front wall fold line.

5. A box of foldable material, said box comprising:

a bottom panel, a rear wall, a front wall disposed approximately parallel to said rear wall, a first diagonal wall disposed adjacent to and at an oblique angle to said rear wall, a first side wall disposed perpendicular to said front wall, a cover hingedly attached to a top edge of said rear wall.

6. The box defined in claim 5:

wherein said foldable material is paperboard;

said box further comprising:

a second diagonal wall opposing said first diagonal wall and disposed adjacent to and at an oblique angle to said rear wall, a second side wall opposing said first side wall and disposed perpendicular to said front wall.

7. A one-piece blank of foldable material cut and scored to define:

a bottom panel having opposing front and rear edges, opposing left and right edges disposed perpendicular to said front edge, and opposing first and second diagonal edges disposed at an oblique angle to said left and right edges, respectively, and extending toward said rear edge, a rear panel hingedly attached to said bottom panel at said rear edge, a front panel hingedly attached to said bottom panel at said front edge, left and right panels hingedly attached to said bottom panel at said left and right edges, respectively, first and second diagonal panels hingedly attached to said bottom panel at said first and second diagonal edges, respectively, a cover panel hingedly attached to a top edge of said rear panel.

8. A box of foldable material, said box comprising:

a bottom panel, a rear wall, a plurality of other walls including:

(a) a front wall opposing said rear wall, (b) opposing first and second diagonal walls disposed adjacent to and at an oblique angle to said rear wall, said first and second diagonal walls each having a plane, (c) first and second side walls disposed perpendicular to said front wall and at an oblique angle to said first and second diagonal walls, respectively;

said rear wall and at least two of said other walls being hingedly attached to said bottom panel, a cover hingedly attached to a top edge of said rear wall, said cover comprising a cover panel having a rear cover edge and first and second sections of recessed cover edge, said first section of recessed cover edge being disposed between first and second edge points on said cover panel, a substantial portion of said first section of recessed cover edge being disposed on an exterior side of the plane of said first diagonal wall, said second section of recessed cover edge being disposed between third and fourth edge points on said cover panel, a substantial portion of said second section of recessed cover edge being disposed on an exterior side of the plane of said second diagonal wall.

* * * * *